United States Patent [19]

Smith

[11] Patent Number: 4,969,084

[45] Date of Patent: Nov. 6, 1990

[54] SUPERHEATER SPRAY FLOW CONTROL FOR VARIABLE PRESSURE OPERATION

[75] Inventor: John W. Smith, Massillon, Ohio

[73] Assignee: The Babcock & Wilcox Company, New Orleans, La.

[21] Appl. No.: 288,589

[22] Filed: Dec. 22, 1988

[51] Int. Cl.[5] ..... G05B 13/2; F22D 7/42; F22G 3/00; F22G 5/00

[52] U.S. Cl. ..... 364/165; 364/494; 60/667; 122/460; 122/476; 122/479.1

[58] Field of Search ..... 364/165, 494; 60/660, 60/661, 662, 663, 664, 653, 667; 122/479 R, 460, 476

[56] References Cited

U.S. PATENT DOCUMENTS

| | | | |
|---|---|---|---|
| 4,027,145 | 5/1977 | McDonald et al. | 364/165 |
| 4,241,701 | 12/1980 | Morse | 122/479 R |
| 4,319,320 | 3/1982 | Sato et al. | 364/494 |
| 4,549,503 | 10/1985 | Keyes, IV et al. | 122/460 |
| 4,776,301 | 10/1988 | Dziubakowski | 122/479 R |
| 4,887,431 | 12/1989 | Peet | 60/667 |

*Primary Examiner*—Jerry Smith
*Assistant Examiner*—Jim Trammell
*Attorney, Agent, or Firm*—Vytas R. Matas; Robert J. Edwards

[57] ABSTRACT

A superheater spray water control system for variable pressure applications produces an output signal representative of expected superheater absorption as a function of measured steam flow, compensates the signal for temperature variations within the superheater and adjusts it for over/under fire transients. An output signal representative of required superheater absorption from the drum to the superheater outlet, together with a spray water enthalpy signal obtained as a function of measured stem flow, is used with the compensated and adjusted actual superheater absorption and measured steam flow signals to produce a spray quantity demand signal.

2 Claims, 2 Drawing Sheets

SUPERHEATER SPRAY FLOW CONTROL FOR VARIABLE PRESSURE OPERATION

TECHNICAL FIELD

The present invention relates, in general, to a spray control system for a superheater and, in particular, to a superheater spray control system that can be utilized in variable pressure applications.

BACKGROUND ART

The control of superheater temperature may be accomplished through a spray attemperator and a control system that positions the spray flow control valve. Such a control system is based on steam temperature error. It has been found, however, that such a control system has a poor response time and can result in potentially unstable control.

The systems usually employed for boilers connected to steam turbines operating at a constant throttle pressure utilize various control approaches to achieve more stable operation and faster response time. For example, a system might control the attemperator outlet temperature to a set point which is adjusted based on outlet steam temperature error. Alternatively, a system could include a feed forward program for spray flow with the spray flow controlled to a demand determined by the program along with steam temperature error. Either of these approaches is quite satisfactory for applications involving constant pressure operation but is inadequate for variable pressure applications due to the variations in temperature within the superheater and the large changes in spray flow caused by variations in operating pressure. These inadequacies are further increased in those applications which include a pressure control valve within the superheater since such a control valve increases the number of possible operating conditions.

Because of the foregoing, it has become desirable to develop a superheater spray control system that can be utilized in variable pressure applications and can compensate for temperature variations within the superheater.

SUMMARY OF THE INVENTION

The present invention solves the problems associated with the prior art and other problems by providing a system for determining the superheater water spray demand in variable pressure applications. The system accomplishes the foregoing by predicting the superheater absorption and by adjusting same to compensate for temperature error to determine actual superheater absorption. The required superheater absorption is also determined based on actual unit operating conditions including the pressures at various locations within the unit. The system processes factors representative of the foregoing actual superheater absorption and the required superheater absorption and measurements representative of the enthalpy of the steam within the drum and the enthalpy of the water spray, along with a measurement of steam flow, to determine the superheater water spray demand.

DESCRIPTION OF THE PREFERRED EMBODIMENT

Figure 1:
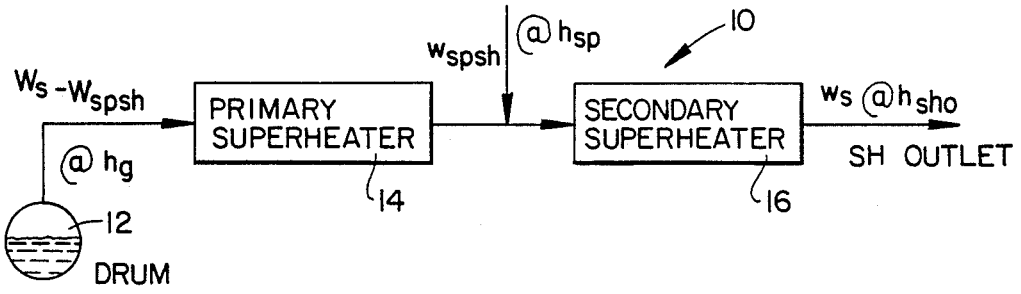
FIG. 1 is a schematic diagram of a portion of a boiler water steam system.

Referring now to the drawings where the illustrations are for the purpose of describing the preferred embodiment of the present invention and are not intended to limit the invention hereto, FIG. 1 is a schematic diagram of a portion of a boiler water/steam system 10 for a turbine. The portion of the system 10 illustrated includes a steam drum 12 associated with a boiler (not shown), a primary superheater 14 connected to the output of the steam drum 12, and a secondary superheater 16 connected to the output of the primary superheater 14. The output of the steam drum 12 is shown as the steam flow $W_s$ minus the spray water applied to the superheater, shown as $W_{spsh}$. The enthalpy of the steam flow from the steam drum 12 to the primary superheater 14 is shown as $h_g$. The water spray applied to the primary superheater 14 and secondary superheater 16 is shown as $W_{spsh}$, and this water spray has an enthalpy of $h_{sp}$. The output of the secondary superheater 16 is shown as steam flow $W_s$ and this output has an enthalpy of $h_{sho}$. From the foregoing, a simple heat and mass balance around the steam drum 12 to the output of the secondary superheater 16 can be performed to obtain the general equation for the amount of water spray needed by the superheater for a given amount of excess superheater absorption. In general, an equation representing the aforementioned schematic diagram under actual operating conditions, can be written as follows:

$$(W_s - W_{spsh})h_g + \text{Actual Absorption} = W_s\, h_{sho} \quad (1)$$

A second equation representing the above under required conditions, i.e., no spray being applied to the superheater, is as follows:

$$W_s\, h_g + \text{Required Absorption} = W_s\, h_{sho} \quad (2)$$

If equation (2) is subtracted from equation (1) and if Excess Absorption equals Actual Absorption minus Required Absorption, the following equations result:

$$-(W_{spsh})h_g + (W_{spsh})h_{sp} + \text{Excess Absorption} = O$$

$$W_{spsh}(h_{sp} - h_g) + \text{Excess Absorption} = O$$

$$W_{spsh} = \frac{\text{Excess Absorption}}{h_g - h_{sp}}$$

It has been found that the actual absorption by the superheaters can be characterized as the product of the steam flow $W_s$ and some function of the steam flow $f(W_s)$ and it has been similarly found that the required superheater absorption can be characterized as the product of the steam flow $W_s$ multiplied by the enthalpy of the steam at the outlet of the superheater ($h_{sho}$) minus the enthalpy of the steam ($h_g$) in the steam drum. The foregoing relationships are shown in the following equations:

$$W_{spsh} = \frac{\text{Excess Absorption}}{h_g - h_{sp}}$$

$$W_{spsh} = \frac{\text{Actual Absorption} - \text{Required Absorption}}{h_g - h_{sp}}$$

-continued $$W_{spsh} = \frac{W_s f(W_s) - W_s(h_{sho} - h_g)}{h_g - h_{sp}} \quad (3)$$

$$W_{spsh} = W_s \frac{f(W_s) - (h_{sho} - h_g)}{h_g - h_{sp}} \quad (4)$$

From the foregoing, it is apparent that by predicting superheater absorption and by using this predicted absorption to determine actual superheater absorption, the water spray flow to the superheater $W_{spsh}$ can be determined.

Figure 2:
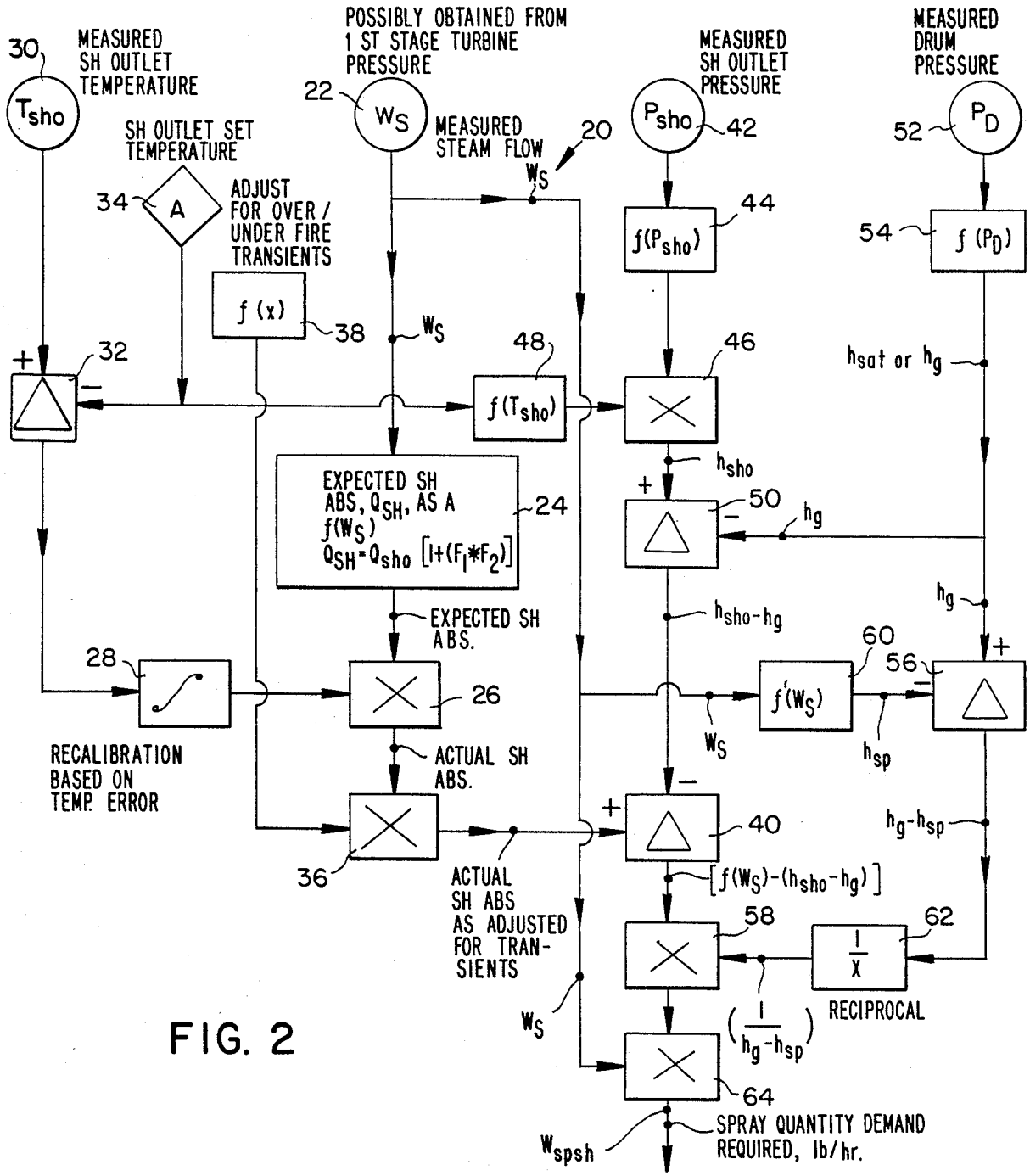
FIG. 2 is a schematic diagram in the form of function blocks which produce an output indicative of superheater water spray demand.

Referring now to FIG. 2, a schematic diagram of a control system 20 in the form of function blocks is illustrated. This system 20 produces an output representative of superheater water spray demand $W_{spsh}$ based on superheater absorption. In this FIG., a steam flow measuring device 22 is provided and produces an output signal representative of steam flow $W_s$. The output of the steam flow measuring device 22 is to a function block 24 which produces an expected value of superheater absorption. The output of the function block 24 is connected to an input of a multiplier 26 whose other input is connected to the output of an integrator 28. A superheater outlet temperature measuring device 30 is provided to produce an output signal representative of the temperature of the steam at the outlet of the superheater. The output of the superheater outlet temperature measuring output of a superheater outlet temperature set point device 34. The output of the difference function block 32 is connected to the input of the integrator 28, thus causing the multiplier 26 to compensate the temperature variations within the superheater which might affect spray flow thereto. In this manner, the output signal produced by the multiplier 26 represents the actual superheater absorption per unit system flow and the actual total superheater absorption and can be characterized by the factor $W_s f(W_s)$. The, output of the multiplier 26 is connected to one input of a multiplier 36 whose other input is connected to a function block 38 which acts as an adjustment for over/under fire transients. The output signal produced by multiplier 36 represents actual superheater absorption adjusted for over/under fire transients and is applied to the positive input a difference function block 40.

A superheater outlet pressure measuring device 42 is provided and produces an output signal representative of pressure at the outlet of the superheater. The output of the pressure measuring device 42 is connected to a function block 44 which produces an output signal that is a function of the pressure at the outlet of the superheater. This output signal is applied to the input of a multiplier 46 whose other input is connected to the output of the superheater outlet temperature set point device 34 via a function block 48 which produces an output signal that is a function of the temperature at the outlet of the superheater. The output signal produced by the multiplier 46 is representative of the enthalpy $h_{sho}$ of the steam at the outlet of the superheater and is applied to the positive input of a difference function block 50. A drum pressure measuring device 52 is provided and produces an output signal representative of the pressure within the steam drum 12. The output of the drum pressure measuring device 52 is connected to a function block 54 which produces an output signal that is a function of the pressure within the steam drum. The output of the function block 54 is connected to the negative input of the difference function block 50 and to the positive input of a difference function block 56. The output signal produced by the difference function block 50 is representative of the difference between the enthalpy $h_{sho}$ of the steam at the outlet of the superheater and the enthalpy $h_g$ of the steam in the drum. Thus, the output signal produced by the difference function block 50 is representative of the required superheater absorption and takes into consideration changes in spray flow caused by variations in operating pressure. The output of difference function block 50 is connected to the negative input of difference function block 40. . Inasmuch as the signal applied to the positive input of difference function block 40 is representative of the actual absorption of the superheater as adjusted for transients, the output signal produced by difference function block 40 is representative of the difference between the actual superheater absorption per unit steam flow and the required superheater of absorption per unit steam flow and is applied to an input of multiplier 58. The output of the steam flow measuring device 22 is also applied to a function block 60 which produces a signal representative of the enthalpy $h_{sp}$ of the spray (or alternately the spray temperature may be directly measured) and which is applied to the negative input of difference function block 56. The output signal produced by the difference function block 56 is representative of the difference between the enthalpy $h_g$ of the steam in the drum and the enthalpy $h_{sp}$ of the spray and is applied to a reciprocal function block 62 whose output is connected to the other input of multiplier 58. In this manner, the output signal produced by multiplier 58 is representative of the relationship $$\frac{f(W_s) - (h_{sho} - h_g)}{h_g - h_{sp}}$$

and is applied to a multiplier function block 64 whose other input is connected to the steam flow measuring device 22. The output of the multiplier 64 is representative of equation (4) and represents the superheater water spray demand.

Certain modifications and improvements will occur to those skilled in the art upon reading the foregoing. It should be understood that all such modifications and improvements have been deleted herein for the sake of conciseness and readability, but are properly within the scope of the following claims.

I claim:

1. In a boiler water/steam system having a steam drum which supplies steam to a superheater and means for applying a demand quantity of spray water flow to the superheater, a superheater spray water control system for variable pressure applications, comprising:

means for producing an output signal representative of measured steam flow through the superheater;

means for producing an output signal representative of expected superheater absorption as a function of said measured steam flow;

means for producing an output signal representative of actual superheater absorption by compensating said expected superheater absorption for temperature variations within the superheater which might affect the spray water flow;

means for adjusting said actual superheater absorption signal for over/under fire transients;

means for producing an output signal representative of required superheater absorption as a function of signals representative of measured superheater outlet pressure and temperature, measured steam drum pressure, and spray water enthalpy, said spray water enthalpy signal being obtained as a function of said measured steam flow; and means for producing a spray quantity demand signal as a required superheater absorption as a function of signals representative of measured superheater outlet pressure and temperature, measured steam drum pressure, and spray water enthalpy, said spray water enthalpy signal being obtained as a function of said measured steam flow; and means for producing a spray quantity demand signal as a function of signals representative of a difference between said adjusted actual superheater absorption and said required superheater absorption, said spray water enthalpy, and said measured steam flow.

2. The system as defined in claim 1, wherein said means for producing said actual superheater absorption signal includes a comparator which receives signals representative of measured superheater outlet steam temperature and of a superheater outlet steam temperature setpoint, and provides an output signal representative of the difference therebetween to an integrator whose output signal is multiplied times said actual superheater absorption signal to produce said temperature variation compensation.

* * * * *